US008357249B2

(12) United States Patent
Cho et al.

(10) Patent No.: US 8,357,249 B2
(45) Date of Patent: Jan. 22, 2013

(54) HIGH STRENGTH, HEAT TREATABLE ALUMINUM ALLOY

(75) Inventors: Alex Cho, Cottageville, WV (US); Kenneth Paul Smith, Parkersburg, WV (US); Victor B. Dangerfield, Canton, GA (US)

(73) Assignee: Constellium Rolled Products Ravenswood, LLC, Ravenswood, WV (US)

( * ) Notice: Subject to any disclaimer, the term of this patent is extended or adjusted under 35 U.S.C. 154(b) by 478 days.

(21) Appl. No.: 11/771,647

(22) Filed: Jun. 29, 2007

(65) Prior Publication Data

US 2008/0056932 A1 Mar. 6, 2008

Related U.S. Application Data

(60) Provisional application No. 60/817,403, filed on Jun. 30, 2006.

(51) Int. Cl.
*C22C 21/10* (2006.01)

(52) U.S. Cl. ..... 148/440; 148/439; 420/511

(58) Field of Classification Search ..... 420/528, 420/540–543, 552–553, 415, 437, 440, 549, 420/688–698, 702; 148/415, 437, 440, 549, 148/688–698, 702, 528, 540–543, 552–553
See application file for complete search history.

(56) References Cited

U.S. PATENT DOCUMENTS

| | | | | |
|---|---|---|---|---|
| 3,542,606 | A * | 11/1970 | Westerman et al. | 148/694 |
| 3,943,039 | A | 3/1976 | Wittrock | |
| 5,772,800 | A * | 6/1998 | Heinz et al. | 148/502 |
| 2002/0150498 | A1 * | 10/2002 | Chakrabarti et al. | 420/532 |
| 2006/0000094 | A1 * | 1/2006 | Garesche et al. | 29/894.353 |
| 2007/0074791 | A1 | 4/2007 | Yoshida et al. | |

FOREIGN PATENT DOCUMENTS

| | | | |
|---|---|---|---|
| EP | 1081242 | A | 3/2001 |
| FR | 2237971 | A | 2/1975 |
| FR | 2307890 | A | 11/1976 |
| FR | 2744136 | A | 8/1997 |
| JP | 61238937 | A | 10/1986 |
| JP | 01127642 | A | 5/1989 |
| JP | 1275743 | | 11/1989 |
| JP | 05295478 | A | 11/1993 |
| JP | 07164880 | A | 6/1995 |
| JP | 9256129 | | 9/1997 |
| JP | 09310141 | A | 12/1997 |

OTHER PUBLICATIONS

Lyle et al. "Aluminum Alloys." Ullmann's Encyclopedia of Industrial Chemistry. 2002.*

Hufnagel, "Key to Aluminum Alloys, 4th Edition," Aluminum-Schluessel = Key to Aluminum Alloys, 1991, pp. 195-205, XP002194851 p. 9; Examples 7046, 7146.

International Search Report dated Dec. 18, 2007, from PCT/US2007/072513.

Hatch, John E., Constitution of Alloys, Book, 1984, Aluminum Property and Physical Metallurgy.

JP Office Action dated Aug. 21, 2012, for Application No. 2009-518579.

* cited by examiner

*Primary Examiner* — Stanley Silverman
*Assistant Examiner* — Brian Walck
(74) *Attorney, Agent, or Firm* — Banner & Witcoff, Ltd.

(57) ABSTRACT

A high strength aluminum alloy is suitable for ultra thick gauge wrought product. The alloy can have 6 to 8 wt % zinc, 1 to 2 wt % magnesium, and dispersoid forming elements such as Zr, Mn, Cr, Ti, and/or Sc with the balance made of aluminum and incidental elements and/or impurities. The alloy is suitable for many uses, including in molds for injection-molded plastics.

14 Claims, 8 Drawing Sheets

HIGH STRENGTH, HEAT TREATABLE ALUMINUM ALLOY

CROSS-REFERENCE TO RELATED APPLICATION

The present application claims priority to and the benefit of U.S. Provisional Application No. 60/817,403, filed on Jun. 30, 2006, which application is incorporated herein by reference and made a part hereof.

TECHNICAL FIELD OF THE INVENTION

The present invention relates to aluminum-zinc-magnesium alloys and products made from the alloys. The high strength alloys are heat treatable and have low quench sensitivity. The products are suitable for manufacturing mould for injection-molded plastics.

BACKGROUND

Modern aluminum alloys for high strength application are strengthened by solution heat treatment and fast cooling followed by an age hardening process. Rapid cooling is commonly achieved by cold water quench. Without such a fast quench process immediately after the solution heat treatment, the age hardening process becomes very ineffective.

The fast cooling process is usually carried out by rapid heat transfer into cold water, which has a high heat capacity. However, the internal volume of thick gauge wrought products cannot be quenched sufficiently fast due to slow heat transfer through the thickness of the product. Therefore, an aluminum alloy suitable for very thick gauge product is needed. Such an alloy should be able to maintain good age hardening capability even after a relatively slow quench process.

Fast cooling by cold-water quench has the serious drawback, however, of raising internal residual stress, which is detrimental to machinability. The most common practice to reduce such residual stress is to cold stretch the quenched product by a small amount typically by using a stretcher machine. As the thickness and width of wrought product increases, the force required to stretch such a product increases. In consequence, a powerful stretcher is necessary as the product dimension increases such that the stretcher becomes the limiting factor in deciding the maximum wrought product thickness and width.

The stretcher can be eliminated as a limiting factor if the wrought product can be slow cooled without a cold-water quench after solution treatment. Thus, residual stress would be minimal and cold stretching would not be required.

The desirable high strength aluminum alloy most suitable for ultra thick gauge wrought product should therefore be capable of achieving desirable high strength in age strengthened temper after solution heat treatment followed by a relatively slow quench.

SUMMARY OF THE INVENTION

Aspects of the present invention relate to an Al—Zn—Mg based aluminum alloy, having Zn and Mg as alloying elements. An alloy of the invention is designed to maximize the strengthening effect of $MgZn_2$ precipitates. In one aspect, an alloy of the invention comprises Zn and Mg in a weight ratio of approximately 5:1 to maximize the formation of $MgZn_2$ precipitate particles. In another aspect the invention can have 6%-8% Zn and 1%-2% Mg by weight. In still another aspect, an alloy can further comprise one or more intermetallic dispersoid forming elements such as Zr, Mn, Cr, Ti and/or Sc for grain structure control. One particular composition of this invention is about 6.1 to 6.5% Zn, about 1.1 to 1.5% Mg, about 0.1% Zr and about 0.02% Ti with the remainder consisting of aluminum and normal and/or inevitable impurities and elements such as Fe and Si. The weights are indicated as being % by weight based on the total weight of the said alloy.

BRIEF DESCRIPTION OF THE DRAWINGS

To understand the present invention, it will now be described by way of example, with reference to the accompanying drawings in which.

DETAILED DESCRIPTION

Figure 1:
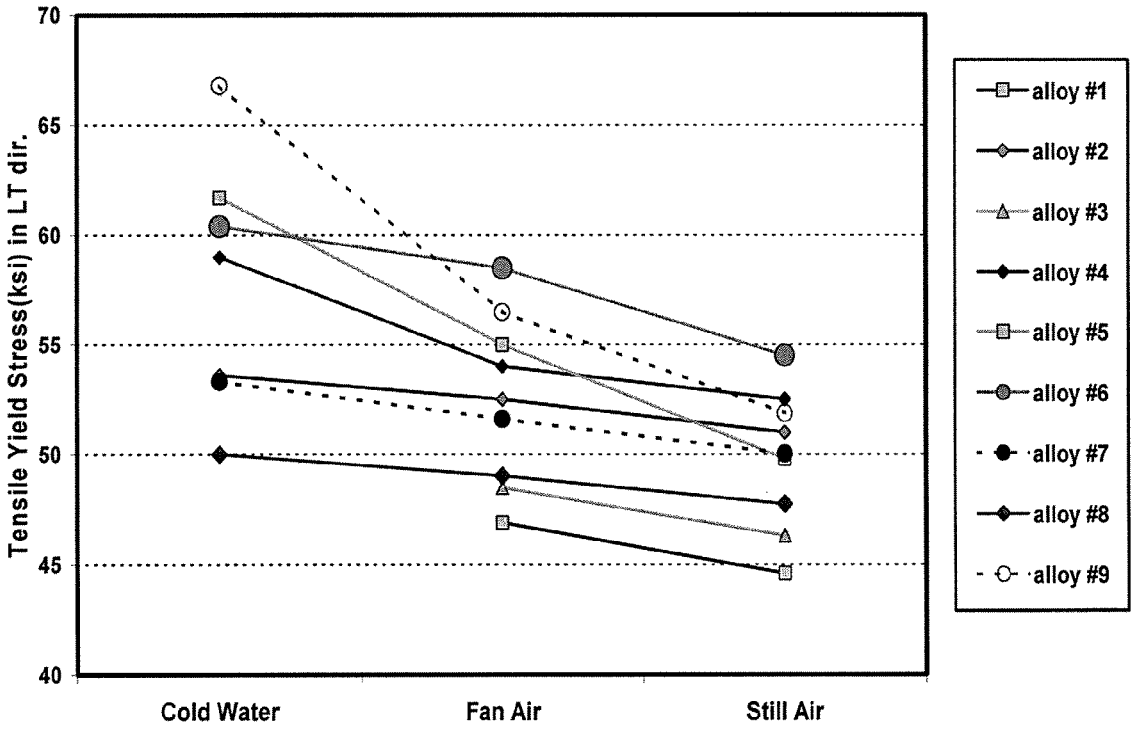
FIG. 1 is a graph illustrating the Tensile Yield Stresses of nine alloys prepared by three different processes.
Figure 2:
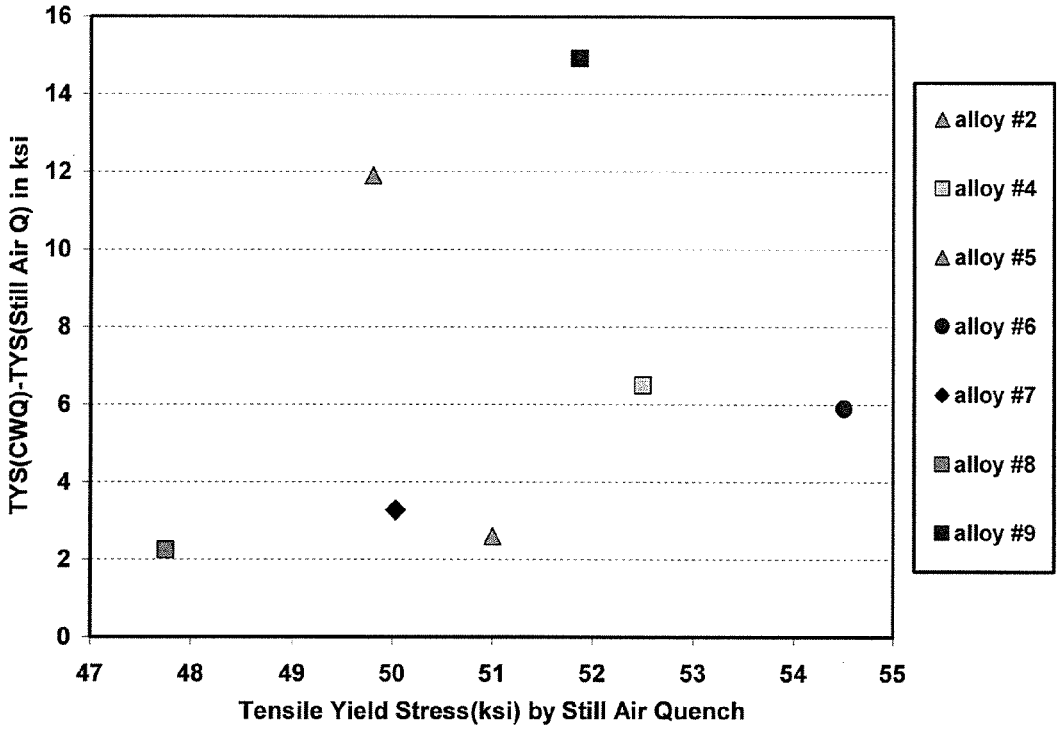
FIG. 2 is a graph illustrating quench sensitivity of seven alloys, where quench sensitivity is measured by loss of tensile yield stress due to still air quench compared to cold-water quench.
Figure 3:
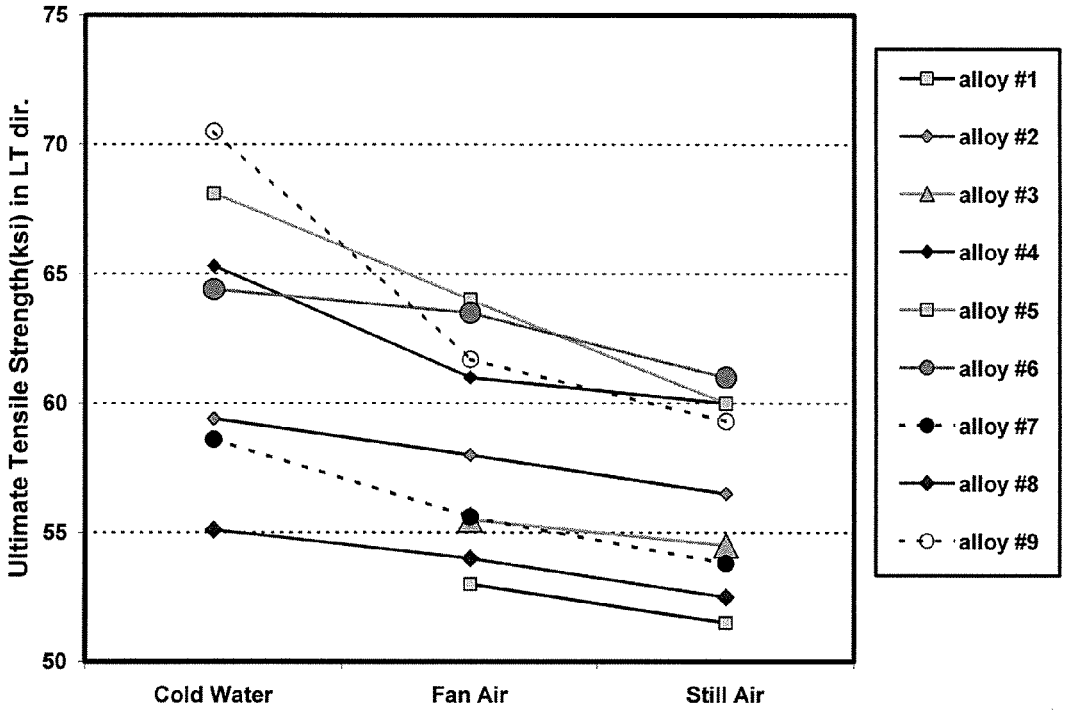
FIG. 3 is a graph illustrating ultimate tensile strengths of nine alloys prepared by three quench processes.
Figure 4:
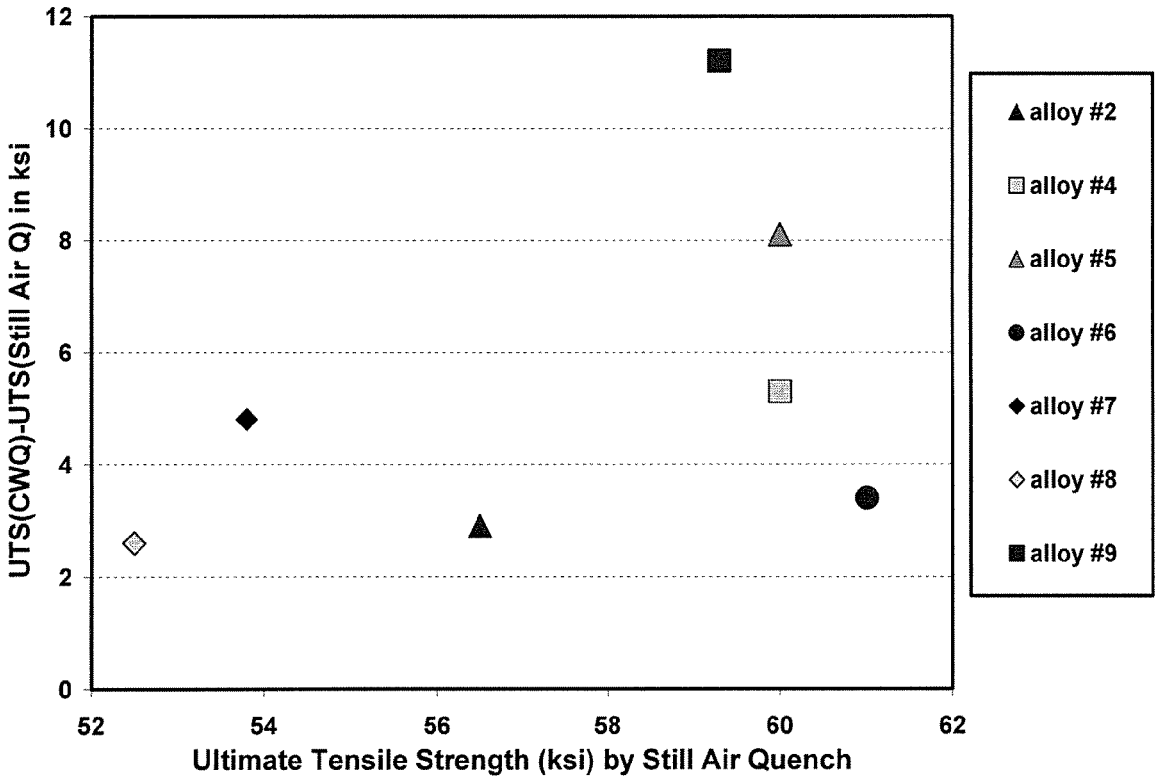
FIG. 4 is a graph illustrating quench sensitivity of seven alloys, where quench sensitivity is measured by loss of ultimate tensile strengths due to still air quench compared to cold-water quench.
Figure 5:
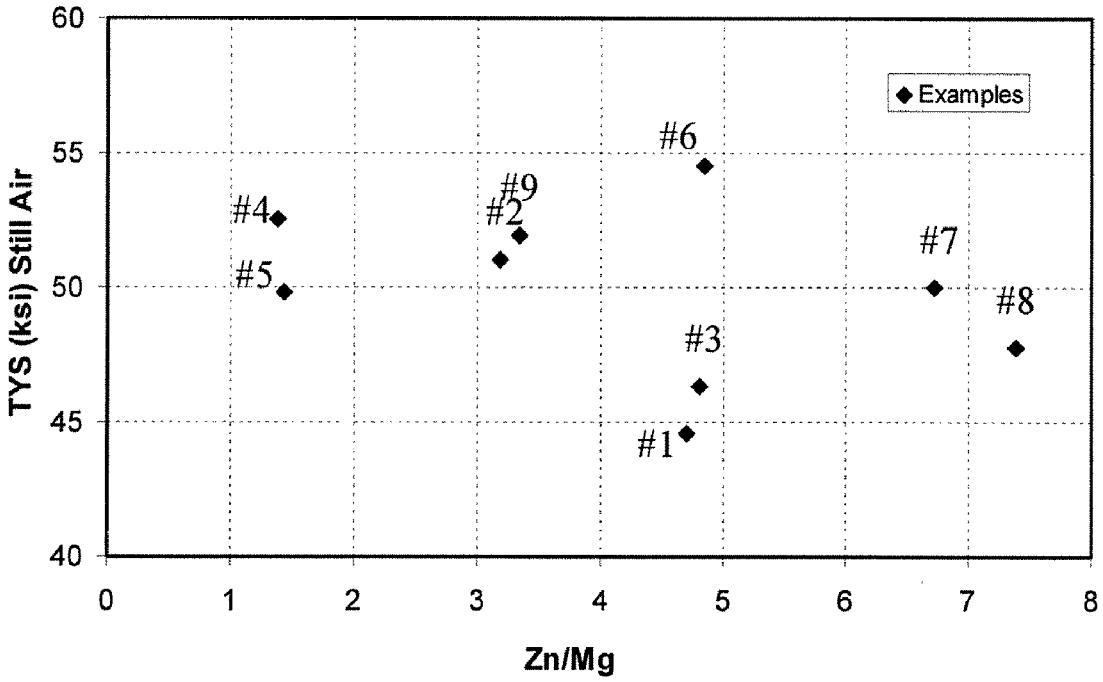
FIG. 5 is a graph illustrating Effect of Zn:Mg ratio on Tensile Yield Stress after slow quench by still air for T6 type temper.
Figure 6:
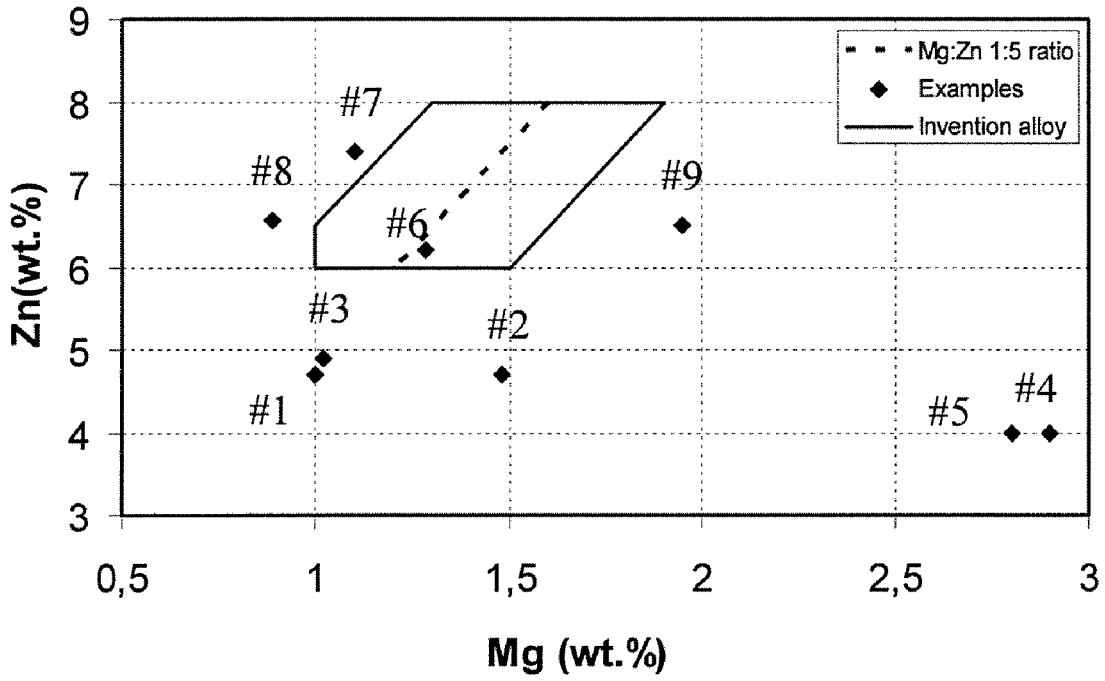
FIG. 6 is a graph illustrating the Zn and Mg composition of the pilot plant trials.

The present disclosure provides that addition of zinc, magnesium, and small amounts of at least one dispersoid-forming element to aluminum unexpectedly results in a superior alloy. The disclosed alloy is suitable for solution heat treatment. Moreover, the alloy retains high strength even without a fast quench cooling step, which is of particular advantage for products having a thick gauge.

Unless otherwise specified, all values for composition used herein are in units of percent by weight (wt %) based on the weight of the alloy.

The definitions of tempers are referenced according to ASTM E716, E1251. The aluminum temper designated T6 indicates that the alloy was solution heat treated and then artificially aged. A T6 temper applies to alloys that are not cold-worked after solution heat-treatment. T6 can also apply to alloys in which cold working has little significant effect on mechanical properties.

Unless mentioned otherwise, static mechanical characteristics, in other words the ultimate tensile strength UTS, the tensile yield stress TYS, and the elongation at fracture E, are determined by a tensile test according to standard ASTM B557, and the location at which the pieces are taken and their direction are defined in standard AMS 2355.

The disclosed aluminum alloy can include 6 to 8 wt. % of zinc. In other exemplary embodiments, the zinc content is from 6.1 to 7.6 wt. % and from 6.2 to 6.7 wt. %. In a further embodiment, the zinc content is about 6.1 to about 6.5 wt. %. The disclosed aluminum alloy can also include 1 to 2 wt. % magnesium. In other exemplary embodiments, the magnesium content is from 1.1 to 1.6 wt. % and from 1.2 to 1.5 wt. %. In a further embodiment, the magnesium content is about 1.1 to about 1.5 wt. %.

In one embodiment, the alloy has essentially no copper and/or manganese. By essentially no copper, it is meant that the copper content is less than 0.5 wt. % in one embodiment, and less than 0.3 wt. % in another embodiment. By essentially no manganese, it is meant that the manganese content is less than 0.2 wt. % in one embodiment, and less than 0.1 wt. % in another embodiment. In certain embodiments, the alloy has an aggregate content of from about 0.06 wt % up to about 0.3 wt. % of one or more dispersoid-forming elements. In one exemplary embodiment, the alloy has from 0.06 to 0.18 wt. % zirconium and essentially no manganese. However in other embodiments, the alloy contains up to 0.8 wt. % manganese and up to 0.5 wt. % manganese, together with 0.06 to 0.18 wt. % zirconium, or in some instances with essentially no zirconium. By essentially no zirconium it is meant that the zirconium content is less than 0.05 wt. % in one embodiment, and less than 0.03 wt. % in another embodiment.

The relative proportions of magnesium and zinc on the alloy may affect the properties thereof. In one exemplary embodiment, the ratio of zinc to magnesium in the alloy is about 5:1, based on weight. In one embodiment, the Mg content is between (0.2×Zn−0.3) wt. % to (0.2×Zn+0.3) wt. %, and in another embodiment, the Mg content is between (0.2×Zn−0.2) wt. % to (0.2×Zn+0.2) wt. %. In a further embodiment, the Mg content is between (0.2×Zn−0.1) wt. % to (0.2×Zn+0.1) wt. %. In this equation, "Zn" refers to the Zn content expressed in wt. %.

The invention is particularly suitable for ultra thick gauge products such as as-cast products or wrought products manufactured by rolling, forging or extrusion processes or combination thereof. By ultra thick gauge, it is meant that the gauge is at least 4 inches and, in some embodiments, at least 6 inches.

One exemplary embodiment of a process for producing ultra thick gauge rolled products is characterized by the following steps:

- casting an ingot of an alloy of the invention with a thickness of at least 12 inches;
- homogenizing the ingot, at a temperature range of 820° F. to 980° F. in one embodiment, and at a temperature range of 850° F. to 950° F. in another embodiment,
- optionally hot rolling the product to its final thickness, preferably from 4 to 22 inches, in the temperature range 600° F. to 900° F.;
- optionally solution heat treating the resulting product, at a temperature range of 820° F. to 980° F. in one embodiment, and at a temperature range of 850° F. to 950° F. in another embodiment;
- quenching or cooling the product by forced air or in a water mist or by very low volume water spray to avoid rigorous quenching and to avoid raising high internal residual stresses;
- artificially age hardening the product, preferably at a temperature range 240° F. to 320° F.

Experiments were performed to compare the disclosed alloy (Example 1: Alloy #6 and Example 2: Samples 10 and 11) to conventional aluminum alloys. In the experiments, described below, conventional alloy 7108 (Example 1: Alloy #1), eight variation alloys (Example 1: Alloys #2 to #5 and #7 to #9), alloy AA6061 (Example 2) Samples 12 to 14) and alloy AA7075 (Example 2: Samples 15 and 16) were compared to the disclosed alloy.

EXAMPLES

Example 1

Nine aluminum alloys were cast as a 7" diameter round billet, having a chemical composition as listed in Table 1.

The billet were homogenized for 24 hours at a temperature range of 850° F. to 890° F. The billet were then hot rolled to form a 1" thick plate at a temperature range of 600° F. to 850° F. The final thickness of 1" was used to evaluate the quench sensitivity of the alloy by employing various slow cooling processes in order to simulate the quench process of ultra thick gauge wrought product. The plates were divided into two or three pieces (piece A, piece B and piece C) for comparison of different quench rates after solution heat treatment. Piece A was solution heat treated at 885° F. for 1.5 hours and air cooled (still air) for slow quench rate of 0.28-0.30° F./sec. Piece B was solution heat treated at 885° F. for 1.5 hours and quenched by fan-moved air for a quench rate of 0.70-0.75° F./sec. Piece C was solution heat treated at 885° F. for 2 hours and cold water quenched, followed by cold work stretch of 2%. The cooling rate during the cold-water quench was too fast to be measured at the time. All pieces were strengthened by artificial aging for 16 hours at 280° F. Tensile test results are listed in Table 2.

TABLE 1

Chemical Composition of Tested Aluminum Alloys (wt %), Remainder Aluminum

| Alloy | Cu | Mn | Mg | Zn | Zr | Ti |
|---|---|---|---|---|---|---|
| Alloy #1 | 0.0 | 0.0 | 1.0 | 4.7 | 0.13 | 0.02 |
| Alloy #2 | 0.01 | 0.0 | 1.48 | 4.7 | — | 0.02 |
| Alloy #3 | 0.49 | 0.0 | 1.02 | 4.9 | 0.05 | 0.02 |
| Alloy #4 | 0.0 | 0.0 | 2.9 | 4.0 | 0.0 | 0.02 |
| Alloy #5 | 0.01 | 0.0 | 2.8 | 4.0 | 0.075 | 0.02 |
| Alloy #6 | 0.0 | 0.0 | 1.28 | 6.2 | 0.05 | 0.02 |
| Alloy #7 | 0.01 | 0.0 | 1.1 | 7.4 | 0.11 | 0.025 |
| Alloy #8 | 0 | 0.0 | 0.89 | 6.57 | 0.11 | 0.02 |
| Alloy #9 | 0.0 | 0.0 | 1.95 | 6.51 | 0.11 | 0.02 |

TABLE 2

Tensile Properties in the Longitudinal (LT) Direction in T6 Temper for Alloy #1 to 9 Sample Plates Processed by Different Quench Methods

| Alloy | Piece | Quenching | UTS (ksi) | TYS (ksi) | Elongation (%) |
|---|---|---|---|---|---|
| Alloy #1 | Piece A | Still Air | 51.5 | 44.6 | 13.0 |
| | Piece B | Fan cool | 53.0 | 46.9 | 11.0 |
| Alloy #2 | Piece A | Still Air | 56.5 | 51.0 | 7.0 |
| | Piece B | Fan cool | 58.0 | 52.5 | 9.0 |
| | Piece C | Cold Water | 59.4 | 53.6 | 15.0 |
| Alloy #3 | Piece A | Still Air | 54.5 | 46.3 | 13.5 |
| | Piece B | Fan air | 55.5 | 48.5 | 14.5 |
| Alloy #4 | Piece A | Still Air | 60.0 | 52.5 | 8.0 |
| | Piece B | Fan cool | 61.0 | 54.0 | 9.5 |
| | Piece C | Cold Water | 65.3 | 59.0 | 17.0 |
| Alloy #5 | Piece A | Still Air | 60.0 | 49.8 | 12.5 |
| | Piece B | Fan cool | 64.0 | 55.0 | 13.0 |
| | Piece C | Cold Water | 68.1 | 61.7 | 15.0 |
| Alloy #6 | Piece A | Still Air | 61.0 | 54.5 | 10.5 |
| | Piece B | Fan cool | 63.5 | 58.5 | 11.5 |
| | Piece C | Cold Water | 64.4 | 60.4 | 15.0 |
| Alloy #7 | Piece A | Still Air | 53.8 | 50.0 | 10.7 |
| | Piece B | Fan cool | 55.6 | 51.6 | 14.0 |
| | Piece C | Cold Water | 58.6 | 53.3 | 13.8 |
| Alloy #8 | Piece A | Still Air | 52.5 | 47.8 | 4.0 |
| | Piece B | Fan cool | 54.0 | 49.0 | 6.4 |
| | Piece C | Cold Water | 55.1 | 50.0 | 12.9 |

TABLE 2-continued

Tensile Properties in the Longitudinal (LT) Direction in T6 Temper for Alloy #1 to 9 Sample Plates Processed by Different Quench Methods

| Alloy | Piece | Quenching | UTS (ksi) | TYS (ksi) | Elongation (%) |
|---|---|---|---|---|---|
| Alloy #9 | Piece A | Still Air | 59.3 | 51.9 | 3.8 |
| | Piece B | Fan cool | 61.7 | 56.5 | 2.4 |
| | Piece C | Cold Water | 70.5 | 66.8 | 8.0 |

TABLE 3

Tensile Yield Stress (ksi) by Three Different Process and Loss of TYS Due to "Still Air" Quench Compared to Cold Water Quench

| | Cold Water | Fan Air | Still Air | CW – Still Air |
|---|---|---|---|---|
| Alloy#1 | not avail. | 46.9 | 44.6 | not avail. |
| Alloy#2 | 53.6 | 52.5 | 51 | 2.6 |
| Alloy#3 | not avail. | 48.5 | 46.3 | not avail. |
| Alloy#4 | 59 | 54 | 52.5 | 6.5 |
| Alloy#5 | 61.7 | 55 | 49.8 | 11.9 |
| Alloy#6 | 60.4 | 58.5 | 54.5 | 5.9 |
| Alloy#7 | 53.3 | 51.6 | 50.0 | 3.3 |
| Alloy#8 | 50.0 | 49.0 | 47.8 | 2.2 |
| Alloy#9 | 66.8 | 56.47 | 51.9 | 14.9 |

TABLE 4

Ultimate Tensile Strengths (ksi) From the Samples Quenched by Three Different Processes

| | Cold Water | Fan Air | Still Air | CW – Still Air |
|---|---|---|---|---|
| Alloy#1 | not avail. | 53 | 51.5 | not avail. |
| Alloy#2 | 59.4 | 58 | 56.5 | 2.9 |
| Alloy#3 | not avail. | 55.5 | 54.5 | not avail. |
| Alloy#4 | 65.3 | 61 | 60 | 5.3 |
| Alloy#5 | 68.1 | 64 | 60 | 8.1 |
| Alloy#6 | 64.4 | 63.5 | 61 | 3.4 |
| Alloy#7 | 58.6 | 55.6 | 53.8 | 4.8 |
| Alloy#8 | 55.1 | 54.0 | 52.5 | 2.6 |
| Alloy#9 | 70.5 | 61.7 | 59.3 | 11.2 |

As shown in FIGS. 1 to 5 and tables 2 to 4, the ultimate tensile strength (UTS) and tensile yield stress (TYS) of Alloy #6, an exemplary embodiment of the disclosed alloy, are higher than the UTS and TYS of Alloys #1-5 and 7-9, when the materials were processed by Still-Air quench, the slowest cooling method evaluated in this study. Furthermore, Alloy #6 shows the most desirable combination of high strength and low quench sensitivity among the four high strength alloys examined.

To validate the desirable characteristics of the exemplary Alloy #6 for ultra thick gauge wrought product, two commercial scale full size ingots were cast to evaluate 6 inch and 12 inch gauge plate properties.

Example 2

A full commercial size ingot with a target chemistry of Alloy #6 defined above was cast for a plant scale production trial. The actual chemical composition is listed in Table 5 (Sample 10). The 18 inch thick, 60 inch wide, and 165 inch long ingot was homogenized at a temperature range of 900° F. to 940° F. for 24 hours. The ingot was pre heated to 900° F. to 920° F. and hot rolled to 6 inch gauge plate at a temperature range of 740° F. to 840° F.

The 6 inch thick plate was solution heat treated at 940° F. for 20 hours and cold water quenched. The plate was stress relieved by cold stretching at a nominal amount of 2%. The plate was age hardened by an artificial aging of 16 hours at 280° F. The final mechanical properties are shown in the Table 6. Corrosion behavior was satisfactory.

Another full commercial size ingot with a target chemistry of Alloy #6 above was cast for a plant scale production trial. The actual chemical composition is listed in Table 5 (Sample 11) The full plant size ingot having a cross section dimension of 18 inch thick×60 inch wide was homogenized at a temperature range of 900° F. to 940° F. for 24 hours. The ingot was pre heated to 900° F. to 920° F. and hot rolled to 12 inch gauge plate at a temperature range of 740° F. to 840° F.

The 12 inch thick plate was solution heat treated at 940° F. for 20 hours and cold water quenched. The plate was age hardened by an artificial aging of 28 hours at 280° F. The final mechanical properties are shown in the Table 6. Corrosion behavior was satisfactory.

In order to evaluate the superior material performance of the inventive alloy for the ultra thick gauge wrought product, additional plant scale trials were conducted with commercially available ultra thick gauge products, namely alloys 6061 and 7075.

A full commercial size 6061 alloy ingot with 25 inch thick× 80 inch wide cross section was cast for a plant scale production trial. The actual chemical composition of the ingot is listed in Table 5 (Sample 12). The ingot was preheated to the temperature range 900° F. to 940° F. and hot rolled to a 6 inch gauge plate.

The 6 inch thick plate was solution heat treated at 1000° F. for 8 hours and cold water quenched. The plate was stress relieved by cold stretching at a nominal amount of 2%. The plate was age hardened by an artificial aging of 8 hours at 350° F. The final mechanical properties are shown in the Table 6.

A full commercial size 6061 alloy ingot with 25 inch thick× 80 inch wide cross section was cast for a plant scale production trial. The actual chemical compositions of the ingot is listed in Table 5 (Sample 13). The ingot was preheated to the temperature range 900° F. to 940° F. and hot rolled to a 12 inch gauge plate.

The 12 inch thick plate was solution heat treated at 1000° F. for 8 hours and cold water quenched. The plate was age hardened by an artificial aging of 8 hours at 350° F. The final mechanical properties are shown in the Table 6.

A full commercial size 6061 alloy ingot with 25 inch thick× 80 inch wide cross section was cast for a plant scale production trial. The actual chemical composition of the ingot is listed in Table 5 (Sample 14). The ingot was preheated to the temperature range 900° F. to 940° F. and hot rolled to a 16 inch gauge plate.

The 16 inch thick plate was solution heat treated at 1000° F. for 8 hours and cold water quenched. The plate was age hardened by an artificial aging of 8 hours at 350° F. The final mechanical properties are shown in the Table 6.

A full commercial size 7075 alloy ingot with 20 inch thick× 65 inch wide cross section was cast for a plant scale production trial. The actual chemical composition of the ingot is listed in Table 5 (Sample 15). The ingot was preheated to 920° F. and hot rolled to 6 inch gauge plate at a temperature range of 740° F. to 820° F.

The 6 inch thick plate was solution heat treated at 900° F. for 6 hours and followed by cold water quench. The plate was stress relieved by cold stretching at a nominal amount of 2%.

The plate was age hardened by an artificial aging of 24 hours at 250° F. The final mechanical properties are shown in the Table 6.

A full commercial size 7075 alloy ingot with 20 inch thick× 65 inch wide cross section was cast for a plant scale production trial. The actual chemical composition of the ingot is listed in Table 5 (Sample 16). The ingot was preheated to 920° F. and hot rolled to 10 inch gauge plate at a temperature range of 740° F. to 820° F.

The 10 inch thick plate was solution heat treated at 900° F. for 6 hours and followed by cold water quench. The plate was age hardened by an artificial aging of 24 hours at 250° F. The final mechanical properties are shown in the Table 6.

Figure 7:
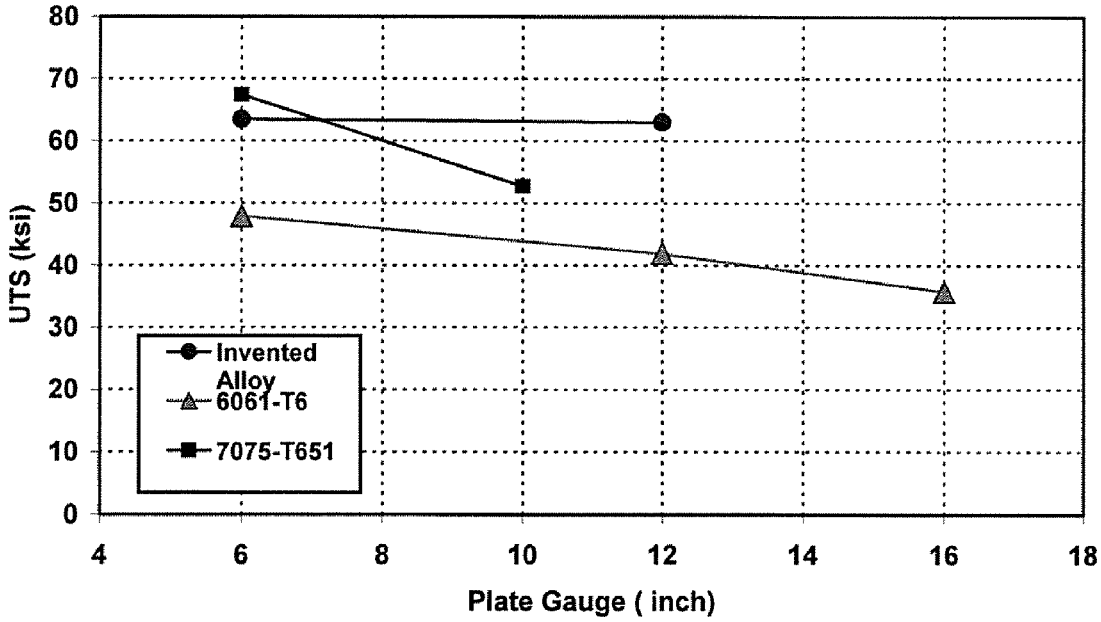
FIG. 7 is a graph illustrating the evolution of Ultimate Tensile Strength with plate gauge for the inventive alloy and comparative alloys.
Figure 8:
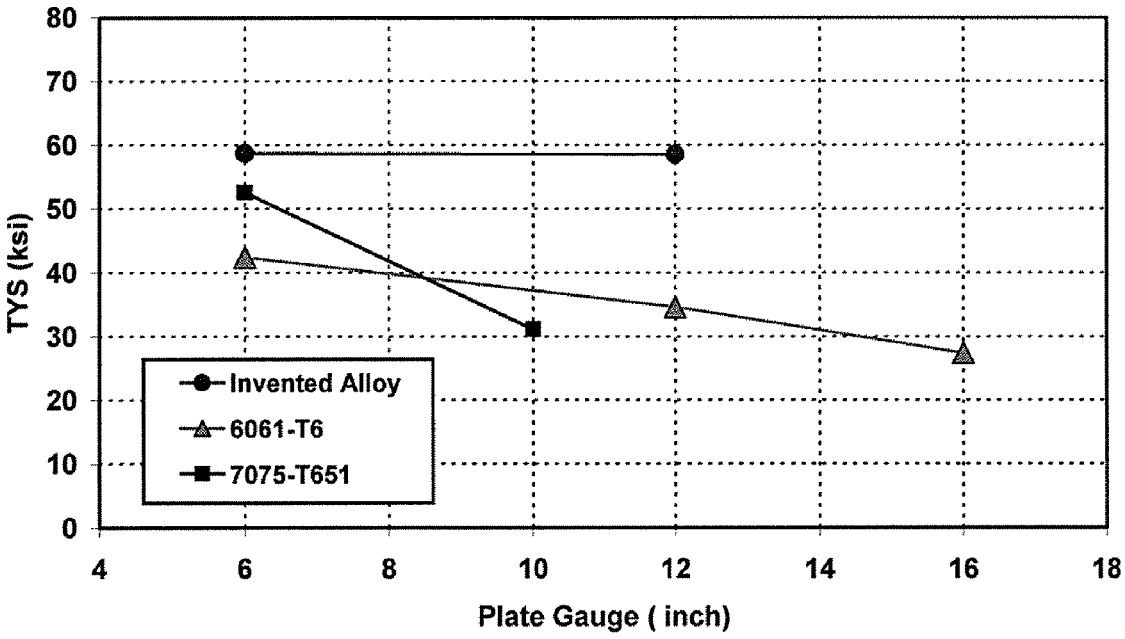
FIG. 8 is a graph illustrating the evolution of Tensile Yield Strength with plate gauge for the inventive alloy and comparative alloys.

Tensile test results from the plant scale production examples are listed in Table 6, and are plotted in FIGS. 7 and 8 for the ultimate tensile strengths and tensile yield stresses, respectively. No loss of mechanical strength is observed with increasing gauge for the invention alloy whereas such a loss is observed for the conventional alloys such as 6061 and 7075 alloys.

TABLE 5

| Chemical composition (wt. %) | | | | | | | | | |
|---|---|---|---|---|---|---|---|---|---|
| Alloy | Si | Fe | Cu | Mn | Mg | Zn | Zr | Ti | Cr |
| Sample 10 | 0.055 | 0.093 | 0.08 | 0.02 | 1.351 | 6.284 | 0.094 | 0.032 | |
| Sample 11 | 0.055 | 0.093 | 0.08 | 0.02 | 1.338 | 6.265 | 0.094 | 0.032 | |
| Sample 12 (6061) | 0.662 | 0.208 | 0.214 | 0.008 | 0.961 | 0.042 | 0.01 | 0.032 | |
| Sample 13 (6061) | 0.691 | 0.209 | 0.2 | 0.2 | 0.981 | 0.043 | 0.01 | 0.037 | |
| Sample 14 (6061) | 0.704 | 0.205 | 0.204. | 0.022 | 1.013 | 0.042 | 0.01 | 0.018 | |
| Sample 15 (7075) | 0.07 | 0.16 | 1.37 | 0.059 | 2.52 | 5.51 | 0.09 | 0.016 | 0.225 |
| Sample 16 (7075) | 0.07 | 0.16 | 1.37. | 0.059 | 2.52 | 5.51 | 0.09 | 0.016 | 0.225 |

TABLE 6

| Tensile properties in LT direction at T/4 location | | | | | |
|---|---|---|---|---|---|
| | Alloy | plate thickness | UTS (ksi) | TYS (ksi) | Elongation (%) |
| Sample 10 | Inventive alloy | 6 inch | 63.5 | 58.7 | 7.4 |
| Sample 11 | Inventive alloy | 12 inch | 63.0 | 58.5 | 6.3 |
| Sample 12 | 6061-T651 | 6 inch | 47.9 | 42.4 | 7.5 |
| Sample 13 | 6061-T6 | 12 inch | 41.9 | 34.6 | 10.3 |
| Sample 14 | 6061-T6 | 16 inch | 35.8 | 27.4 | 10.8 |
| Sample 15 | 7075-T651 | 6 inch | 67.4 | 52.5 | 12.0 |
| Sample 16 | 7075-T6 | 10 inch | 52.7 | 31.1 | 13.5 |

FIGS. 7 and 8. show that no drop of mechanical strength is observed with increasing gauge for invention alloys whereas such a drop is a common feature for 6061 and 7075 alloys.

While particular embodiments and applications of the present invention have been disclosed, the invention is not limited to the precise compositions and processes described in this study. Based on the teachings and scope of this invention, various modifications and changes may be practiced to achieve the surprising and unexpected benefit of this invention. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. Accordingly, while the specific embodiments have been illustrated and described, numerous modifications come to mind without significantly departing from the spirit of the invention and the scope of protection is only limited by the scope of the accompanying claims.

What is claimed is:

1. An aluminum alloy product, consisting essentially of:

from about 6.2 wt. % to about 6.7 wt. % Zn;

from 1 wt. % to about 2 wt. % Mg, wherein Mg is present in an amount from (0.2×Zn−0.3) wt. % to (0.2×Zn+0.3) wt. %;

at least one intermetallic dispersoid forming element selected from a group consisting of Zr and Ti; and balance aluminum and inevitable impurities, wherein the copper content is less than 0.08 wt. %, and wherein the manganese content is less than 0.1 wt. %, and wherein said product is an as-cast product or wrought product manufactured by rolling or forging, with a wall thickness of at least 4 inches, said product being artificially age hardened.

2. The alloy product of claim 1 wherein Mg is present in an amount from 1.1 wt. % to 1.6 wt. %.

3. The alloy product of claim 1 wherein Mg is present in an amount from 1.2 wt. % to 1.5 wt. %.

4. The alloy product of claim 1 wherein Mg is present in an amount from (0.2×Zn−0.2) wt. % to (0.2×Zn+0.2) wt. %.

5. The alloy product of claim 1 wherein said at least one intermetallic dispersoid forming element is present in an aggregate content of about 0.06 wt. % to about 0.3 wt. %.

6. The alloy product of claim 5 further consisting essentially of about 0.02 wt. % Ti.

7. The alloy product of claim 6 further consisting essentially of about 0.06 wt. % to about 0.18 wt. % Zr.

8. The alloy product of claim 1 wherein Zn is present in an amount from about 6.2 wt. % to about 6.5 wt. %.

9. The alloy product of claim 8 wherein Mg is present in an amount from about 1.2 wt. % to about 1.5 wt. %.

10. The alloy product of claim 5 wherein Zr is present in an amount of about 0.1 wt. % and/or Ti is present in an amount of about 0.02 wt. %.

11. The alloy product of claim 1 wherein Mg is present in the alloy in an amount from (0.2×Zn−0.2) wt. % to (0.2×Zn+0.2) wt. %.

12. The alloy product of claim 1 wherein the at least one intermetallic dispersoid forming element includes about 0.02 wt. % Ti and about 0.06 wt. % to about 0.18 wt. % Zr.

13. The alloy product of claim 1 wherein the product is a rolled product, and the rolled product, at quarter thickness, has an ultimate tensile strength of at least about 61 ksi and a tensile yield stress of at least about 54.5 ksi.

14. The alloy product of claim 1 wherein any Cu contained in the alloy is present only as an impurity.

* * * * *